US005370239A

United States Patent [19]

Kidaloski et al.

[11] Patent Number: 5,370,239

[45] Date of Patent: Dec. 6, 1994

[54] INTEGRAL SHIPPING TRUSS ASSEMBLY FOR HEAT RECOVERY STEAM GENERATOR MODULES

[75] Inventors: Raymond G. Kidaloski, Canal Fulton; Roger A. Detzel, Norton; Donald E. Ryan, Mogadore, all of Ohio

[73] Assignee: The Babcock & Wilcox Company, New Orleans, La.

[21] Appl. No.: 44,992

[22] Filed: Apr. 7, 1993

[51] Int. Cl.[5] ..... A47F 5/00

[52] U.S. Cl. ..... 211/13; 211/60.1; 211/189; 410/42

[58] Field of Search ..... 211/13, 70.4, 60.1, 211/189; 60/685, 693, 912; 410/42; 165/172, 900; 414/745.3

[56] References Cited

U.S. PATENT DOCUMENTS

| | | | |
|---|---|---|---|
| 2,248,119 | 7/1941 | Reed et al. | 410/36 X |
| 2,543,274 | 2/1951 | Bender | 410/42 X |
| 4,208,158 | 6/1980 | Davies et al. | 211/70.4 X |
| 4,236,574 | 12/1980 | Bosne | 165/900 X |
| 4,579,304 | 4/1986 | Williams | 165/172 X |
| 4,659,535 | 4/1987 | Couture et al. | 211/60.1 X |

OTHER PUBLICATIONS

Color copy of a page from a Vogt advertisement or sales brochure, Date and citation unknown.

*Primary Examiner*—Robert W. Gibson, Jr.
*Attorney, Agent, or Firm*—Robert J. Edwards; Eric Marich

[57] ABSTRACT

An assembly for shipping and supporting a module for a heat recovery steam generator comprises a base having four vertical truss members slidably mounted to the base at one end. Each vertical truss member is positioned a distance apart from another vertical truss member across the base such that four paths of adjacent vertical truss members define a front, a back and two sides. The assembly further comprises at least one level. Each level comprises a horizontal member rotatably attached to the vertical truss members at the front and the back of the assembly. A junction is fixed to each vertical truss member at both sides of the assembly; a side truss member is rotatably attached to the junctions at both sides. An internal grid is attached to the horizontal truss members between the vertical truss members. Diagonal truss members are removably attached to the junctions at both sides of the assembly between adjacent levels such that the diagonal truss members diagonally extend from the junction of one level to the junction of an adjacent level.

7 Claims, 7 Drawing Sheets

80
90

80
90

80
90
25
12

INTEGRAL SHIPPING TRUSS ASSEMBLY FOR HEAT RECOVERY STEAM GENERATOR MODULES

FIELD AND BACKGROUND OF THE INVENTION

The present invention relates in general to heat recovery steam generators and, in particular, to a new and useful assembly for the shipping and support of modules for heat recovery steam generators.

As shown in FIG. 1, a heat recovery steam generator, generally designated 5, comprises an inlet flue 7 and pressure parts or heat recovery surfaces 15 which are contained inside a box-type structure comprised of cold outer casing or plate material 10 that is internally insulated and lined. The cold outer casing 10 is internally insulated with an insulation layer 34 and lined with a liner 36 as shown in FIG. 6. The cold outer casing 10 is supported by an external support frame 2.

Returning to FIG. 1, high temperature turbine exhaust gas passes through the heat recovery steam generator 5, entering a front end or inlet 7 of the heat recovery steam generator 5. The temperature of the turbine exhaust gas at this point can easily exceed 1000° F. Heat which is given off from the hot turbine exhaust gas is recovered by a working fluid flowing through the pressure parts 15 located within the heat recovery steam generator 5. The heat recovery surfaces 15 are located in modules 12 contained within the casing 10. The turbine exhaust gas passes across the modules 12 to an outlet transition housing 9 which leads to a stack 11 for the exiting of the exhaust gas. At the stack 11, the temperature of the turbine exhaust gas has been reduced to approximately to 200° F.

Because of economic considerations, it is common practice in the heat recovery steam generator field to employ modules 12 which are pre-fabricated and pre-assembled in a shop. Modular design minimizes the amount of field assembly and labor by maximizing the amount of work done in the controlled environment of the manufacturing facility. Once shipped to the field, the modules 12 are field assembled and arranged side-by-side to create the heat recovery steam generator 5. Large heat recovery steam generators 5 can be two or more modules 12 wide.

The cold outer casing 10, insulation layer 34 and liner 36 form panels in what is known as a cold casing design. As illustrated in FIG. 6, these casing panels 10 are usually installed after the modules 12 have been positioned in the field. The casing panels 10 provide the overall strength and stability for the heat recovery steam generator 5 by providing side-to-side as well as fore and aft restraints against potential loadings which can occur as a result of wind and/or seismic conditions.

The pressure parts 15 comprise the most significant portion of the total weight of each module 12 and must be externally supported and restrained by structural tie members 38 for both shipping and erecting purposes. It is common in the heat recovery steam generator field to employ modules 12 having structural shapes comprising wide flanges, channels, and angles for achieving the transportation and construction of the generator 5.

The large sizes required for these types of structural members directly impact the maximum number of pressure parts 15 which can be shipped in a single module 12 due to overall shipping width and weight restrictions. Specifically, the width dimensions for shipping a given module 12 must be less than the allowable clearances specified by regulations for both vehicle and rail transportation. The number of pressure parts 15 which can be shipped in a module 12 is thus a function of the allowable shipping width clearance minus the maximum width of the attached shipping steel side truss members.

Moreover, the number of shippable pressure parts 15 which can be incorporated into a given module 12 is also a function of the maximum permissible shipping weight minus the weight of the shipping steel members used for shipping. In order to stay within the maximum permitted shipping weight, the weight of the shippable pressure parts 15 must be reduced by an amount corresponding to the weight of the shipping steel. Therefore, the heavier the shipping steel, the less the amount of pressure parts 15 which can be incorporated and shipped in a given module 12.

Previous heat recovery steam generator designs have required significant field labor for shipping and erecting. Additionally, in these previous designs, much of the steel that is required for shipping the modules 12 must be removed and discarded after the modules 12 have been erected, resulting in additional expense and waste.

Referring to FIG. 6, the pressure parts 15 of the modules 12 are laterally restrained at several locations along the length of the module 12 by intermediate ties 37. Intermediate ties 37 restrain and support the load of the module 12 during shipment. The ties 37 also prevent buckling and excessive vibration of the pressure parts 15 during operating conditions once the modules 12 have been assembled into the heat recovery steam generator 5.

As illustrated in FIG. 6, for single module 12 wide heat recovery steam generator designs, the intermediate tie steel members 37 penetrate the internal liner 36 and the insulation 34 for support from the cold outer casing 10 and the support frame steel 2. This configuration for the intermediate ties 37 is widely used in known designs. Because of this design, the size of the intermediate ties 37 must be small enough so that the flow of turbine exhaust gas through the modules 12 is not significantly altered or obstructed. In heat recovery steam generators 5 (FIG. 1) that have more than one module 12, the length of the intermediate tie support steel 37 must be significantly increased. The increase in the intermediate tie steel 37 is impractical due to the combination of longer spans, elevated temperatures, and minimum size requirements associated with support steel located in the gas stream.

For multiple module 12 wide designs, a current solution to this problem is to use intermediate tie members 37 that are integral with the pressure parts (i.e., spirally finned tubes) 15. The intermediate tie steel members 37 are welded to the fins on the spirally finned tubes 15 in order to support the tie steel members 37. Because of this configuration, however, the support attachments of tie steel members 37 are prone to failure due to temperature differentials between the tubes, the fins of the heat recovery surfaces 15, and the intermediate tie steel members 37. Additionally, some failures in this design can also be attributed to a lack of well-defined supports and load paths that could accommodate the high design temperatures and loadings of the intermediate tie steel 37 during unit operation.

Currently, there are no known designs which exist that provide for an efficient handling and shipping of a module for a heat recovery steam generator while providing for efficient support during the operation of the unit.

SUMMARY OF THE INVENTION

The main purpose of the present invention is to provide a means to facilitate the fabrication, shipping, and erection of heat recovery steam generator modules by providing an efficiently designed module support structure requiring only a minimal amount of temporary steel removal after module erection at the job site. This new design is similar to previous designs in that it provides lateral restraints at several locations along the length of the module to prevent tube vibration and buckling problems associated with bottom supported pressure parts.

Significantly, the present invention maximizes the number of pressure parts in a shipping module by using readily available rectangular structural tubing for the shipping structure to minimize the width and weight of the shipping modules. Additionally, the shipping steel is then used for lifting and uprighting of the modules during field erection to assemble the heat recovery steam generator.

The new design provides a rigid structure for shop handling, railroad transport, and field lifting and erection. A significant aspect of the present invention is that, after erection, most of the shipping steel remains in place as a permanent, internal support structure to provide additional operational stability for the module and support for the intermediate ties. When in an upright position, only the side truss diagonals are removed. A permanent top truss in combination with the remaining side truss members results in a flexible, yet stable permanent module support structure that encompasses the module pressure parts and remains in place during operation of the heat recovery steam generator.

Accordingly, one aspect of the present invention comprises an assembly for the shipping and supporting of heat recovery steam generator modules. The assembly comprises a base having four vertical members slidably mounted to the base at one end. Each vertical member is positioned a distance apart from another vertical member across the base such that four pairs of adjacent vertical members define a front, a back and two sides for the assembly. The assembly further comprises at least one level. Each level comprises front and rear horizontal members rotatably attached to the vertical members at the front and the back of the assembly. A junction is also fixed to each vertical member at both sides of the assembly and the side truss member is rotatably attached to the junctions at both sides. Each level further comprises an internal grid attached to the front and rear horizontal members between the vertical members. A diagonal truss member is removably attached to the junctions at both sides between the levels such that the diagonal truss member diagonally extends from the junction of a level to a junction of an adjacent level. Heating surfaces are contained within the assembly and extend from the base through each level of the assembly.

The various features of novelty which characterize the invention are pointed out with particularity in the claims; annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
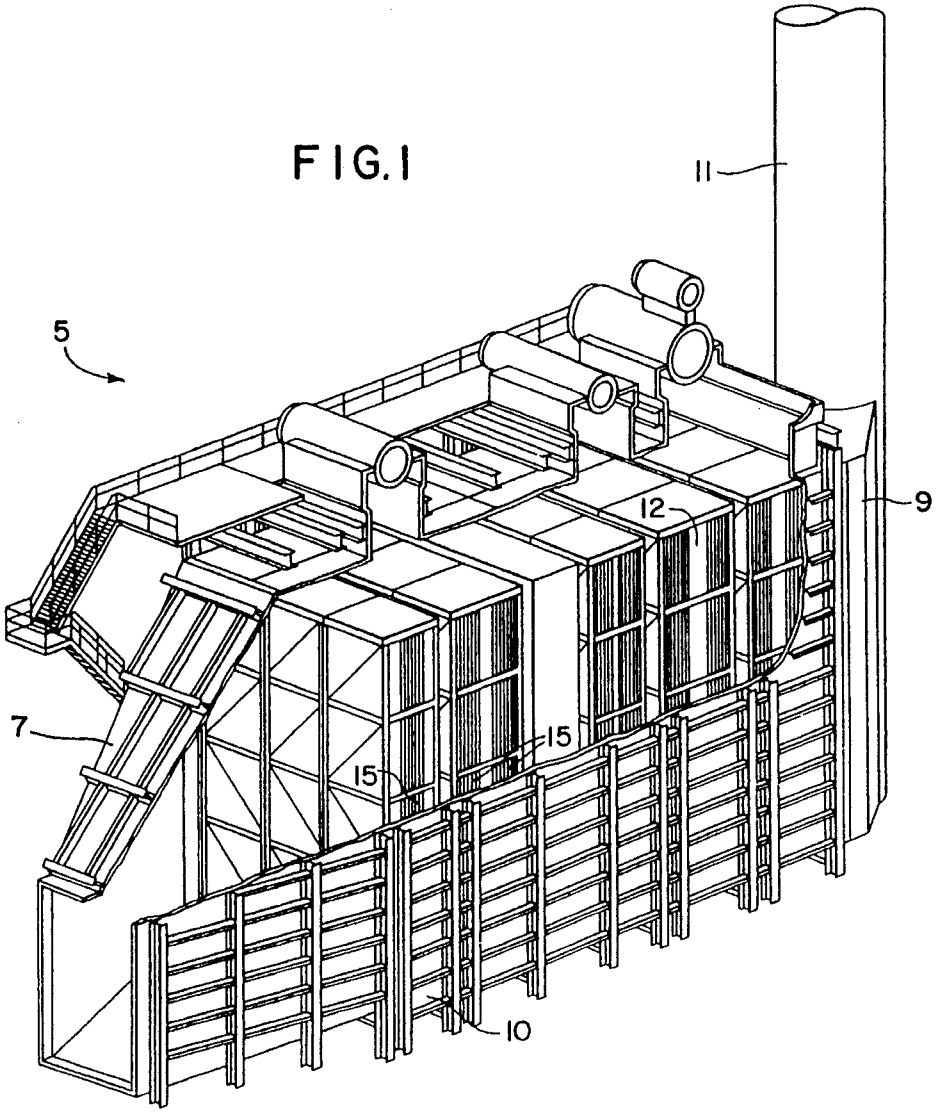
FIG. 1 is a perspective view partially in section of a heat recovery steam generator.
Figure 2:
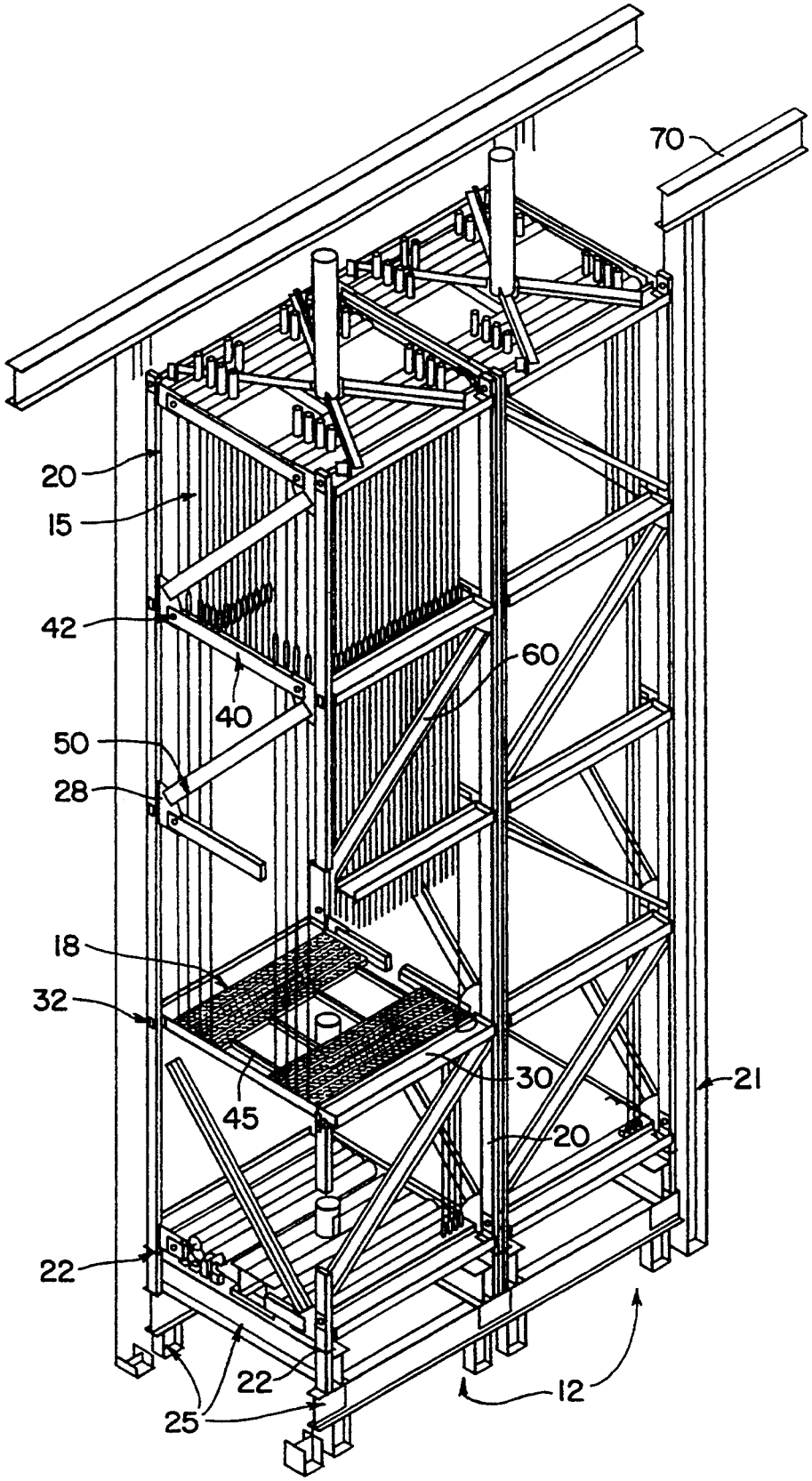
FIG. 2 is a perspective view of two module assemblies according to the present invention.

In the drawings, the same reference numerals are used to designate the same or functionally similar parts. The present invention, as illustrated in FIG. 2, facilitates the fabrication, shipping and erection of a module 12 for a heat recovery steam generator 5 (FIG. 1) by utilizing a support structure or assembly which requires a minimal amount of temporary steel to be removed from the module 12 after erecting at a job site. The present invention provides lateral restraints at several locations along the length of the module 12 in order to prevent vibration of the heat recovery surfaces 15 and buckling problems which are usually associated with these bottom supported pressure parts 15.

The present invention maximizes the number of pressure parts 15 which can be shipped in a module 12. In an important aspect of the present invention, the shipping module 12 is preferably made of standard rectangular structural tubing in order to minimize the width and weight of the shipping modules 12. In the preferred embodiments, the type of rectangular structural tubing employed would be cold formed ASTM Specification A500, Grade B structural tubing, possessing a minimum yield stress $F_Y$=46 ksi (46,000 psi). This is in contrast to the typical minimum yield stress of 36 ksi for ASTM Specification A36 structural steel, typically used in structural steel shapes such as wide flanges, I-beams, channels, and the like. Another reason that this grade B structural tubing was also selected, instead of a lower Grade A type steel ($F_Y$=39 ksi), is because it is normally stocked in local steel service centers, as indicated in the Ninth Edition of the *AISC Manual of Steel Construction,* at TABLE 3, page 1–92, copyright 1989. This Manual is well known to those skilled in the art of steel construction, and provides numerous tables of structural design criteria to permit design of structures using the structural shapes described therein.

FIG. 2 shows each module 12 containing recovery surfaces or pressure parts 15 supported on a base 25, which is preferably rectangular or square. Four vertical truss members 20 are slidably mounted to the base 25 at an end 22 of the vertical members 20. The ends 22 of the vertical members 20 have a sliding surface engageable with the base 25 in order to accommodate horizontal differential motions that arise during the operation of the unit. The present invention can accommodate horizontal differential motions that could occur at the interface between the base frame steel 25 and the support structure members of the module 12.

Each module has a plurality of levels 18 (FIGS. 2, 3, 4 and 7) comprising a horizontal member 30 rotatably attached to the vertical members 20 at a front and a back of the module 12. The horizontal members 30 are attached to the vertical members 20 by a securing means such as a pin 32 which allows for rotational movement such as rotation of the horizontal members 30 about the pin 32.

A junction 28 is fixed to each vertical truss member 20 at each level 18 at the sides of the module 12 adjacent the front and back of the module 12. A side truss member 40 is rotatably attached to the junctions 28 at each side of a level 18. The side truss members 40 are permitted to move by rotation about the junction 28 by a securing means such as a junction pin 42 which rotatably secures the side truss members 40 to the junctions 28.

Figure 3:
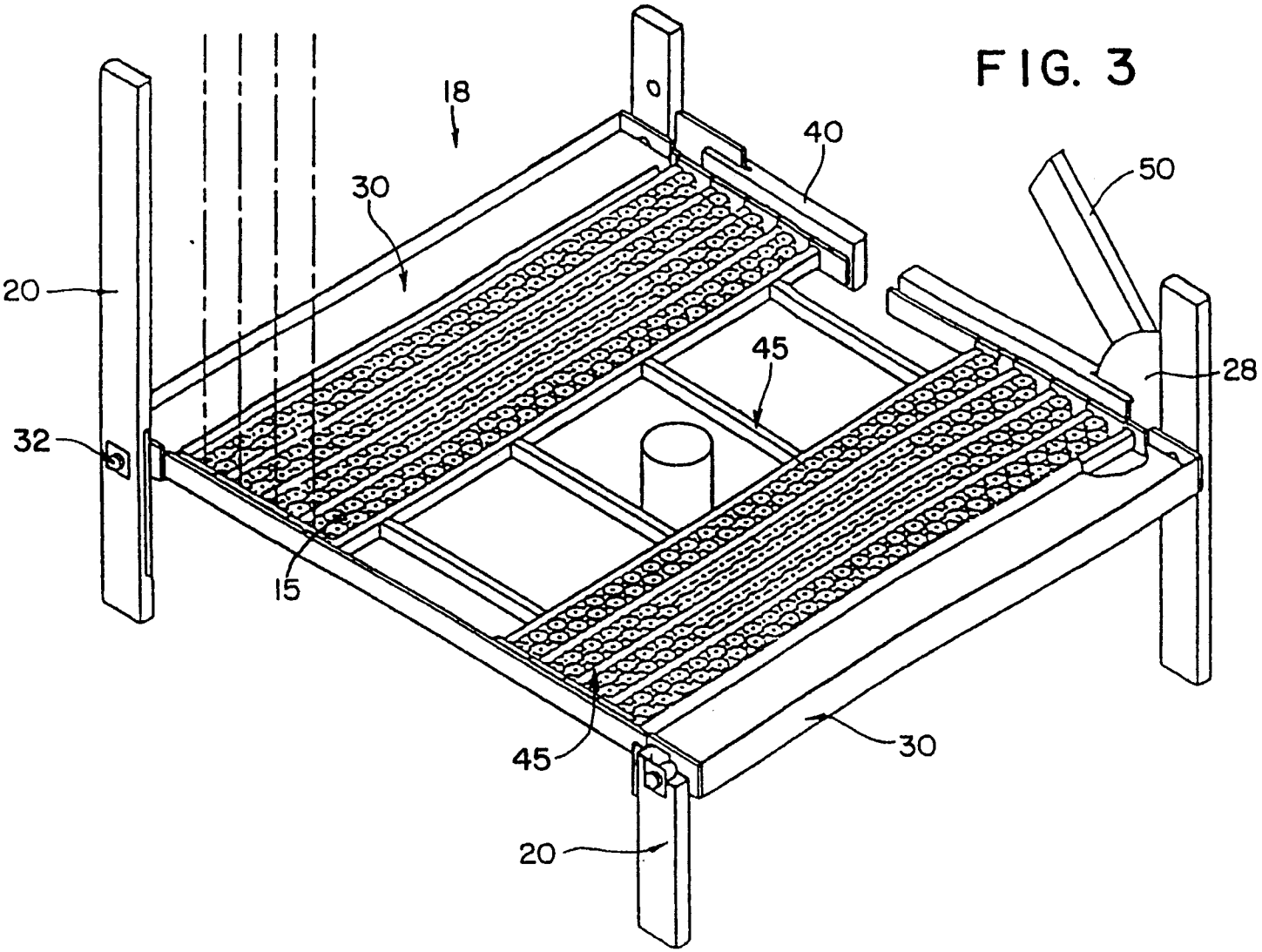
FIG. 3 is a perspective view in section of a level of FIG. 2.

At each level 18, an internal grid 45, as illustrated in FIG. 3, is attached to the horizontal members 30 between the vertical truss members 20. The internal grid 45 accommodates the pressure parts 15 and allows the pressure parts 15 to extend through each level 18 of the module 12.

The internal grid 45 comprises intermediate tie steel which is not an integral part of the vertically oriented finned tubes 15. However, the internal grid 45 is an integral part of the shipping, erecting and permanent structure of the module 12. The internal grid 45 is supported by the horizontal members 30 and are permitted rotational movement about the pins 32 which secure the horizontal members 30 to the vertical truss members 20.

Figure 4:
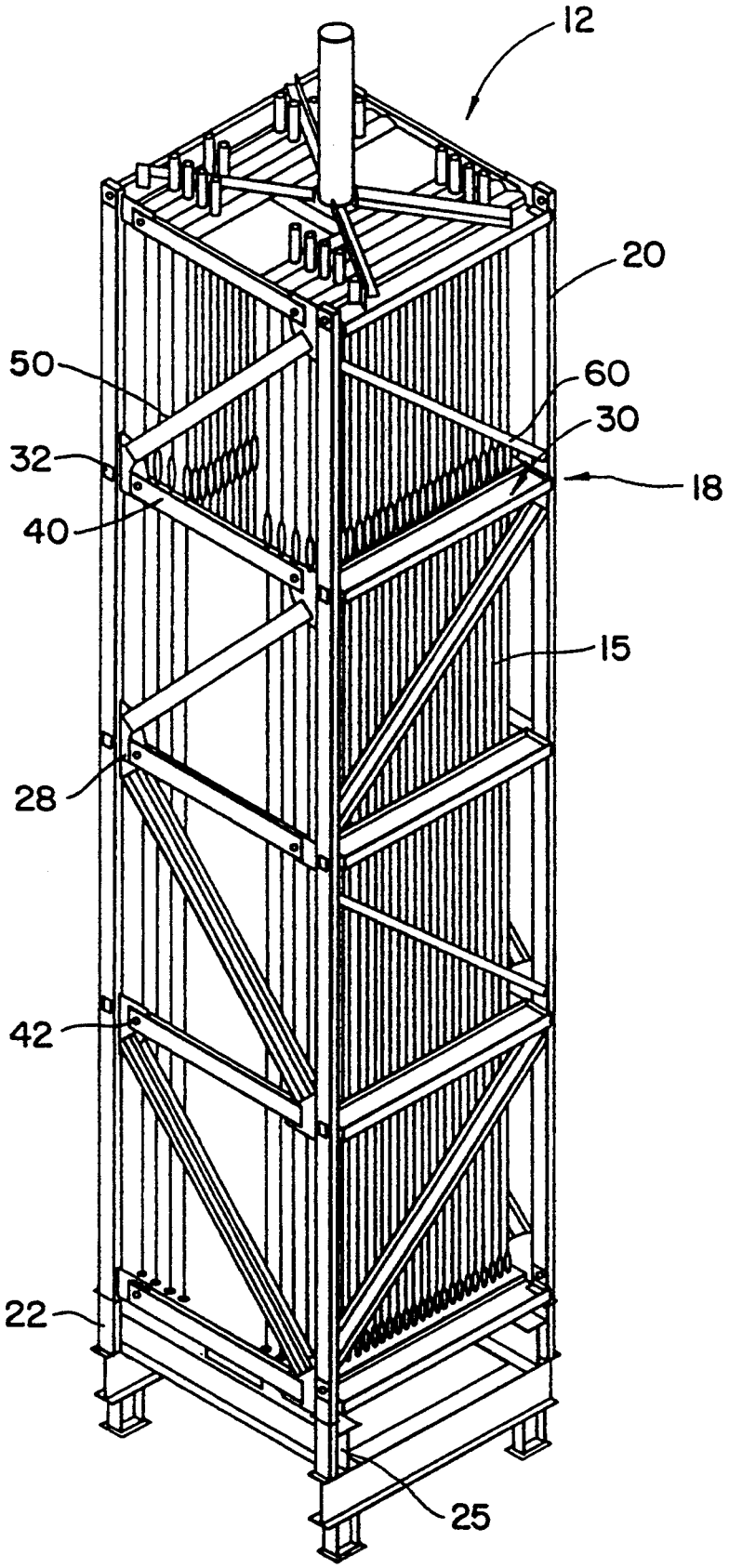
FIG. 4 is a perspective view of a modular assembly of FIG. 2.

A diagonal truss member 50, as illustrated in FIG. 4, is removably attached to the junctions 28 at adjacent levels 18 of the module 12. The diagonal truss member 50 diagonally extends between adjacent levels 18 and is attached to diagonally located junctions 28 of adjacent levels 18. The diagonal truss member 50 is a temporary member which can be welded to the junctions 28 for shipment purposes and removed from the module 12 once the module 12 is erected.

After removing the diagonal truss members 50 from the junctions 28 at each side of the module 12, the side truss members 40 are permitted to move by rotation about the pins 42. The rotational movement of the side truss members 40 permits front to rear differential axial thermal growth experienced by the vertical members 20. The differential growth occurs during the operation of the unit when the gas temperature is reduced through the heat absorption at the pressure parts 15 as the exhaust gas is channeled to the stack 11 (FIG. 1).

FIGS. 2 and 4 illustrate a permanent diagonal support 60 fixed to the vertical members 20 at the front of the module 12 between adjacent levels 18. This overall configuration results in a flexible but stable permanent modular support structure that encompasses the pressure parts 15 of the module 12 and provides stability during the operation of the unit.

Figures 5A, 5B, 5C:
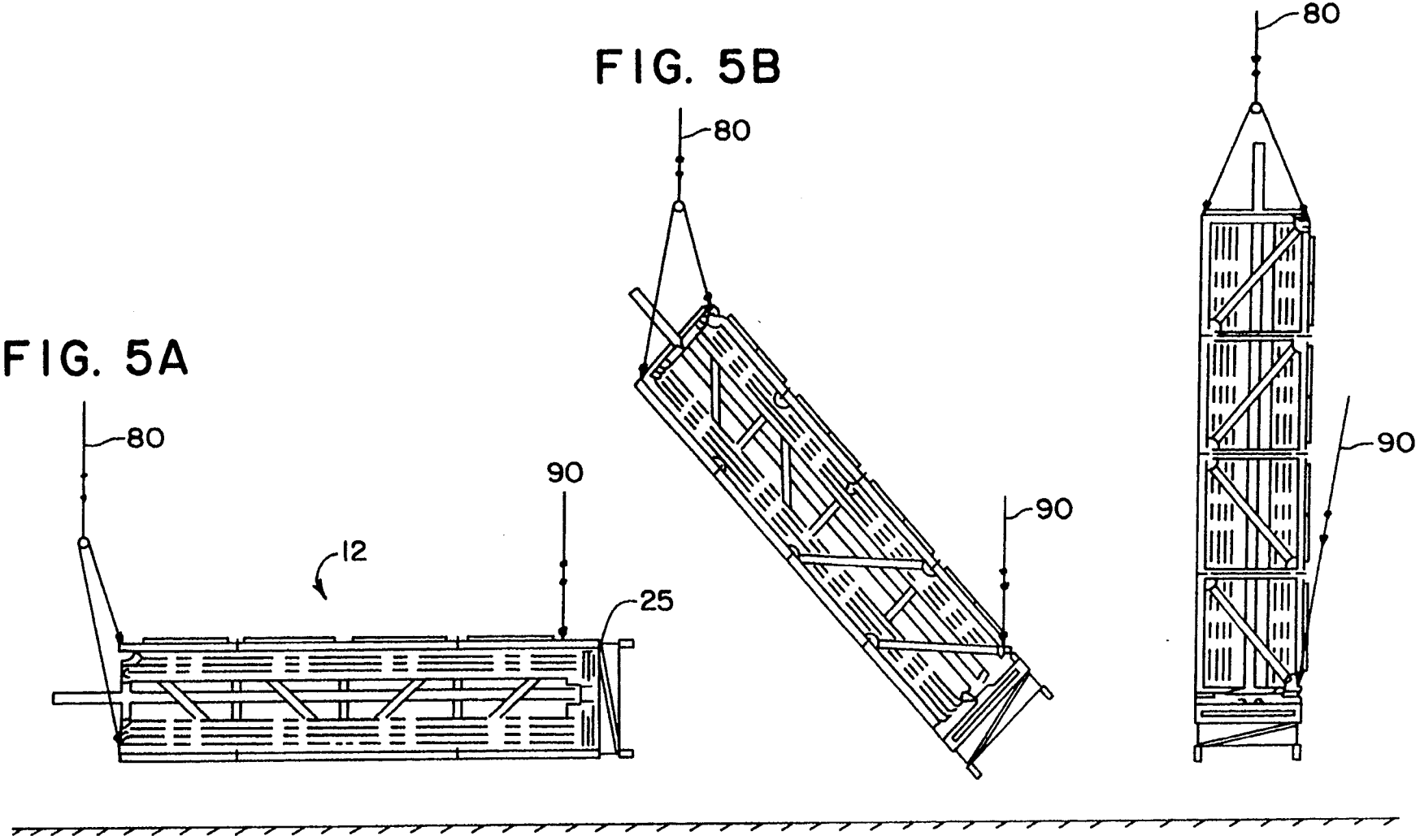
FIGS. 5*a*, 5*b* and 5*c* are views illustrating a lifting sequence for the assembly of FIG. 3.
Figure 6:
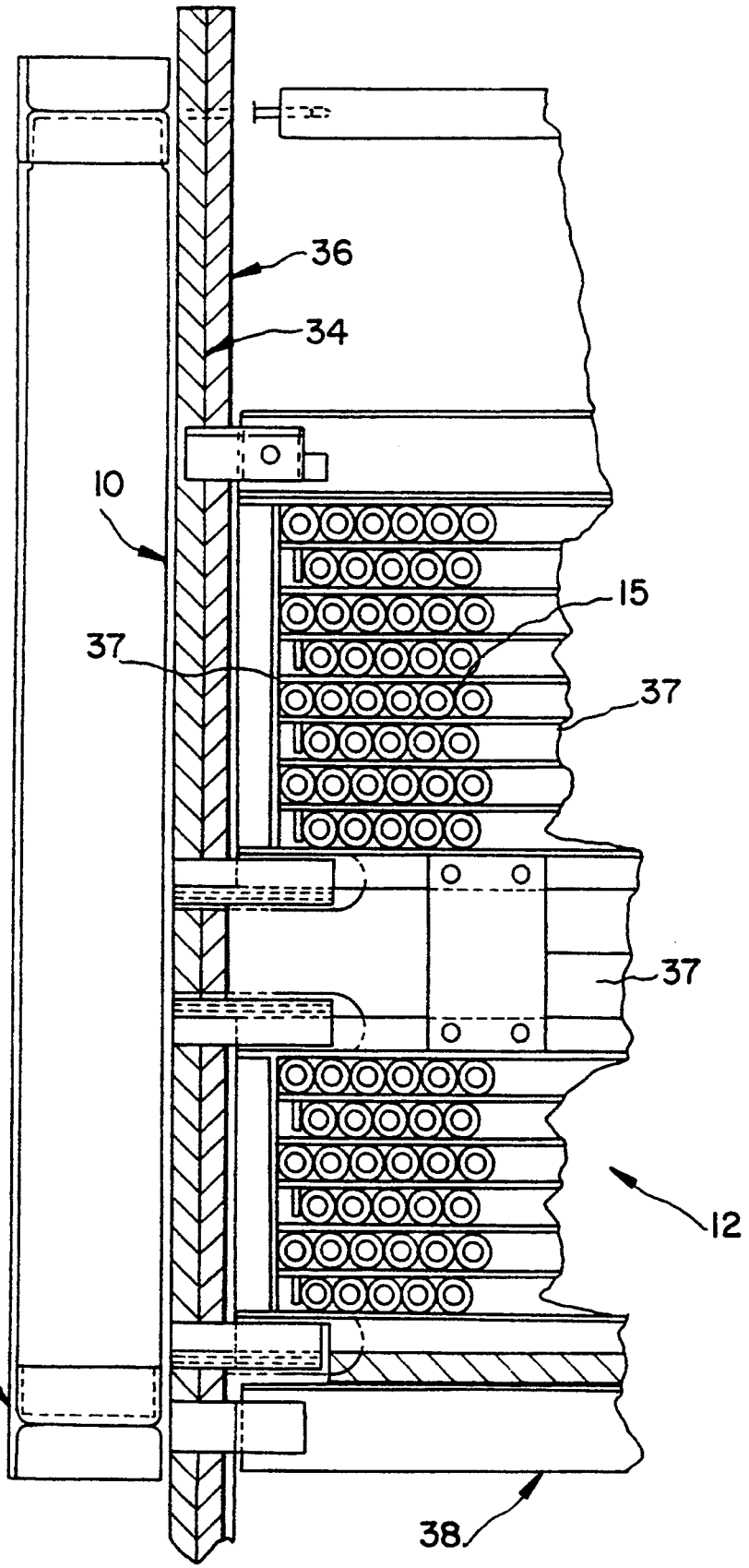
FIG. 6 (PRIOR ART)
FIG. 6 is a partial horizontal sectional view of a known module.
Figure 7:
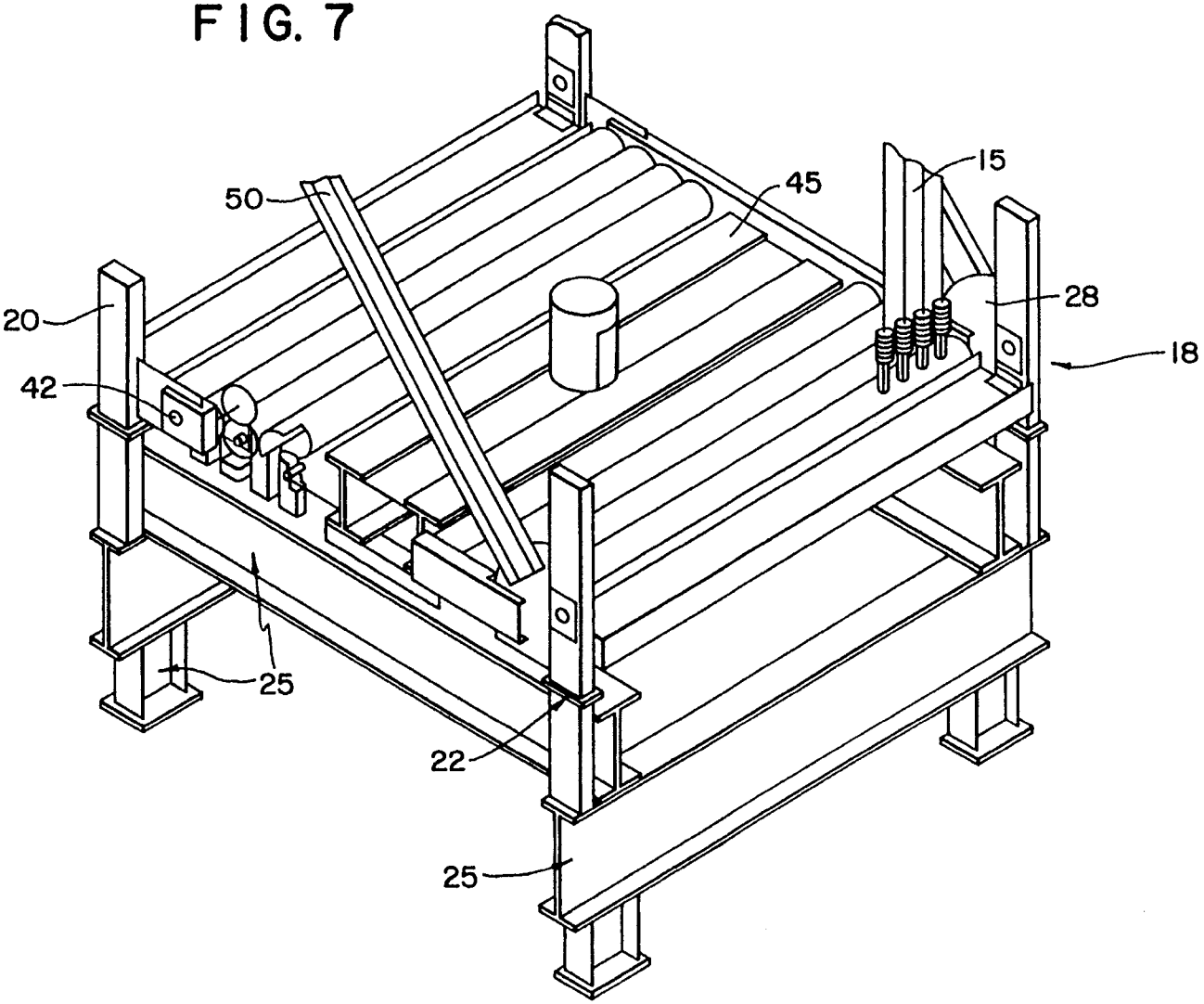
FIG. 7 is a perspective view in section of a second level of FIG. 2.

FIGS. 5*a*, 5*b* and 5*c* illustrate a lifting sequence for the erection of the module 12 in that a base lifting means 90 can be connected to an area at the base 25 for movement for the base 25. Simultaneously, a lifting means 80 can be engaged to the top of the module 12 opposite the base 25 for upward lifting of the top of the module 12.

The present invention provides a rigid structure for easy shop handling, railroad transport and field assembly. A unique characteristic of the present invention is that after the module 12 is erected, the majority of the shipping steel remains in place as a permanent internal support structure for providing additional operation stability for the module 12 and for supporting the intermediate ties 45.

The present invention maximizes the number of pressure parts 15 which can be shipped by minimizing the size, width and height of the shipping truss members which provide for efficient shipment and erecting of the module 12.

The present invention also reduces the amount of field labor required during the erecting of the module 12 in that it requires only that the diagonal truss members 50 be removed after the module 12 has been erected.

The present invention provides a positive means of supporting the weight of the module 12 and accommodating the loads acting on the intermediate ties 45 during operating conditions.

The present invention allows for the entire shipping truss assembly, after the removal of the diagonal truss members 50, to remain permanently in place during the operation of the unit by providing for the differential thermal growth between the cold base frame steel and the hot module support structure members. Additionally, the present invention allows for the transferring of seismic loading to the top and the bottom of the module 12. The effects of differential growth between the horizontal members 30 is minimized during operating conditions through the use of pins 42 for the side truss members 40.

The present invention allows for the module 12 to have its entire weight supported throughout the structure while being lifted by a lifting means and even while it is being moved laterally into its final erecting position.

While a specific embodiment of the invention has been shown and described in detail to illustrate the application of the principles of the invention, it will be understood that the invention may be embodied otherwise without departing from such principles.

We claim:

1. An assembly for supporting an arrangement therein, the assembly comprising:

a base;

four vertical truss members slidably mounted to the base at one end of the members, each vertical truss member positioned a distance apart from another vertical truss member across the base such that four adjacent vertical truss members define a front, a back and two sides;

a plurality of levels comprising front and rear horizontal members rotatably attached to the vertical truss members, a junction fixed to each vertical truss member at both sides, horizontal side truss members rotatably attached to the junctions at both sides, an internal grid attached to the front and rear horizontal members between the vertical truss members; and a diagonal truss member removably attached to the junctions at both sides between adjacent levels, the diagonal truss member diagonally extending from the junction of a level to the junction on an adjacent level.

2. The assembly according to claim 1, wherein the front and rear horizontal members are rotatably attached to the vertical members by securing means.

3. The assembly according to claim 1, wherein the horizontal side truss members are rotatably attached to the junctions by junction securing means.

4. The assembly according to claim 2, wherein the securing means comprises a pin.

5. The assembly according to claim 3, wherein the junction securing means comprises a pin.

6. The assembly according to claim 1, wherein the assembly includes a diagonal support attached to the vertical members at the front and diagonally extending between adjacent levels.

7. The assembly according to claim 1, wherein the vertical and horizontal members are made of standard rectangular structural tubing.

* * * * *